US006368017B2

(12) United States Patent
Black

(10) Patent No.: US 6,368,017 B2
(45) Date of Patent: Apr. 9, 2002

(54) STORM WATER DETENTION FILTER SYSTEM

(76) Inventor: Charles E. Black, 143 F S. Killarney La., Richmond, KY (US) 40475

( * ) Notice: Subject to any disclaimer, the term of this patent is extended or adjusted under 35 U.S.C. 154(b) by 0 days.

(21) Appl. No.: 09/268,780

(22) Filed: Mar. 16, 1999

(51) Int. Cl.[7] ..... E02B 3/04

(52) U.S. Cl. ..... 405/15; 405/36; 405/53; 405/107; 210/170

(58) Field of Search ..... 405/15, 16, 18, 405/36, 107, 111, 115, 116, 284, 53; 210/170

(56) References Cited

U.S. PATENT DOCUMENTS

| | | | | | |
|---|---|---|---|---|---|
| 4,483,640 | A | * | 11/1984 | Berger et al. | 405/15 |
| 4,521,131 | A | * | 6/1985 | Nandlal | 405/116 |
| 4,655,637 | A | * | 4/1987 | Vignocchi | 405/15 |
| 5,076,735 | A | * | 12/1991 | Hilfiker | 405/284 |
| 5,333,970 | A | * | 8/1994 | Heselden | 405/286 |
| 5,582,492 | A | * | 12/1996 | Doyle, Jr. | 405/262 |
| 5,636,938 | A | * | 6/1997 | Ragazzo | 405/15 |
| 5,658,096 | A | * | 8/1997 | Von Kanel | 405/262 |
| 6,036,851 | A | * | 3/2000 | Simmering et al. | 210/150 |

* cited by examiner

*Primary Examiner*—David Bagnell
*Assistant Examiner*—Frederick L. Lagman
(74) *Attorney, Agent, or Firm*—Maurice L. Miller, Jr.

(57) ABSTRACT

A detention filter system for the temporary accumulation and storage of storm water runoff is disclosed for limiting the rate of runoff from a developed tract of land to no more than that which was naturally discharged from the same tract when in its prior undeveloped state. The system includes one or more conventional rip rap filled gabion boxes which may be aligned end-to-end along the edge of a developed parcel of real estate so that storm water can run off into the boxes and temporarily accumulate therein. The system also includes a sheet of porous fabric or perforated sheet, attached to and covering a surface of the gabion boxes to restrict the rate of flow of storm water runoff flowing through the boxes and the sheet to a downstream storm drain, storm sewer or stream. The sheet may be formed of two or more layers of the porous fabric or perforated sheet. The gabion boxes can function to stabilize an earth cut located on a lower edge of a developed tract such as a driveway and parking lot to keep the cut from eroding or can form a porous dam or barrier for a temporary storm water impoundment basin. When the boxes are used against an earth cut, sidewalks and other development can be built over the boxes to minimize the undeveloped area dedicated to the system.

11 Claims, 4 Drawing Sheets

STORM WATER DETENTION FILTER SYSTEM

BACKGROUND OF THE INVENTION

This invention relates generally to means for slowing the rate of liquid run-off from developed residential or commercial real estate tracts so that the rate of run-off from a developed tract does not exceed the natural rate of run-off from the same tract prior to its development. More specifically, this invention relates to a system which employs conventional rock particle filled, wire boxes, known as gabion boxes, which are conventionally used to stabilize a vertical earth cut or earth wall and a porous fabric or perforated sheet attached to and covering one or more of the vertical sides of the boxes such that liquid run-off can flow from a developed real estate tract into the gabion boxes and, thereafter, be discharged at a preselected rate to a stream, storm sewer, storm drain or the like.

In many governmental jurisdictions in this country it is required by law or ordinance that the rate of storm water run-off from a proposed residential or commercial development to be built on a tract of land must not exceed the natural rate of storm water run-off from the tract which existed prior to the proposed development. In some cases, a "variance" can be obtained from the appropriate governmental agency to permit the rate of storm water run-off from the proposed real estate development to be some preselected percentage greater than the natural storm water run-off rate of the undeveloped tract of land on which the development is to be built. In other special cases, a more stringent requirement may be required wherein the storm water run-off rate of the proposed development will be less than the natural run-off rate of the undeveloped tract by some fractional amount or percentage.

To this end, it has been the practice in the prior art to form ponding areas, install underground pipes or build underground vaults on the tract to be developed to temporarily accumulate and store storm water flowing therein from above and from other sections of the property to slow the rate of storm water run-off from the property as a whole. Ponding areas are usually resorted to where there exists an undeveloped low area of the tract, which will not contain buildings, roadways, parking areas or other improvements, to which storm water can drain from other areas of the tract, both developed and undeveloped. Underground pipes having both means for draining surface run-off into them and for discharging the run-off at a preset rate to streams or storm sewers are resorted to where the surface area above the pipes is developed into paved parking areas, side walks, roadways and the like. The drain rate from such ponding areas, underground pipes and vaults to streams, storm sewers and the like for conveyance off of the tract can, of course, be closely controlled by well known means such as, for example, by using weirs, orifices or valves on outlet ports of the pipes. But the use of ponding areas, for example, for the temporary storage of run-off can, in many instances, unduly limit the amount of development permissible on a given tract of land. In some cases, the only area of a tract suitable for containing a ponding area may also be the most desirable area for development, thus limiting proposed development to less suitable areas of the tract.

By means of my invention, these and other difficulties encountered using conventional storm water run-off control facilities is substantially reduced, if not altogether eliminated.

SUMMARY OF THE INVENTION

It is an object of my invention to provide a novel storm water detention filter system for limiting the rate of storm water runoff from a developed tract of land to an amount no greater than that naturally occurring on the tract prior to development.

It is a further object of my invention to provide an elongated storm water detention filter that eliminates the need for dedicating a broad surface area of a tract as a storm water pond or impoundment basin which, as a consequence, can not be developed.

Briefly, in accordance with my invention there is provided a storm water detention filter system which includes at least one gabion box filled with rock particles for receiving storm water runoff from a tract of land therein. The filter system also includes at least one sheet of porous, liquid permeable material attached to and covering at least one vertical surface of the gabion box for reducing the flow rate of storm water passing through the box and sheet from the tract to a storm drain.

These and other objects, features and advantages of the present invention will become apparent to those skilled in the art from the following detailed description and attached drawings upon which, by way of example, only a preferred embodiment and certain other important embodiments of my invention are described and illustrated.

DESCRIPTION OF THE PREFERRED EMBODIMENT

Figure 1:
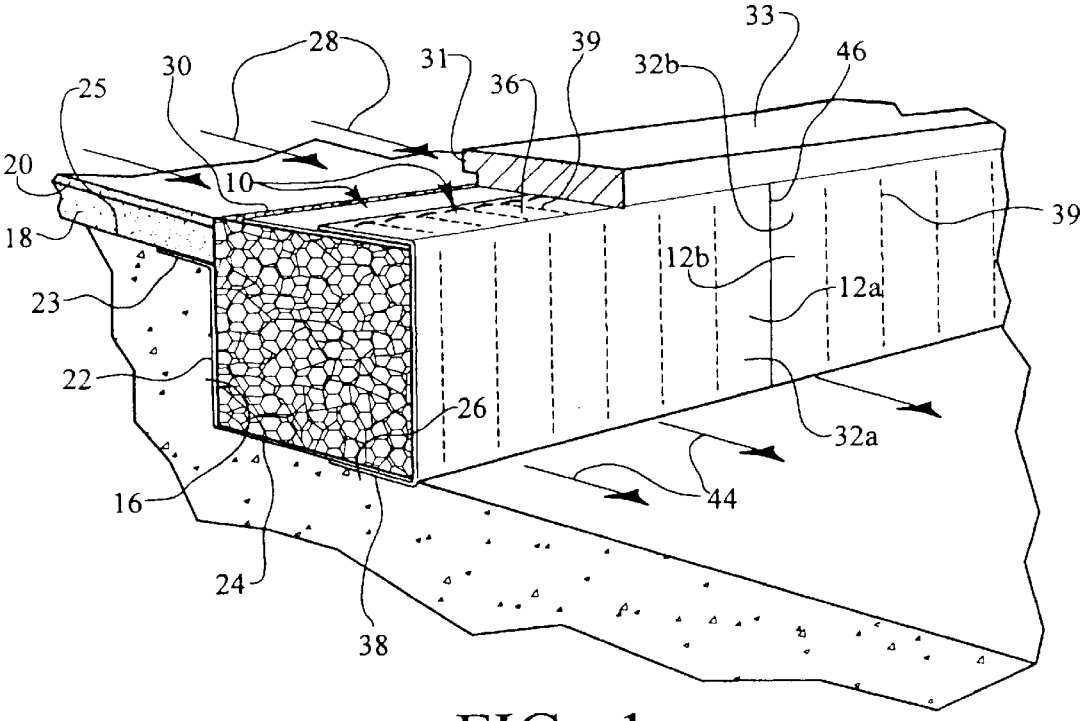
FIG. 1 shows a perspective view of a ground mounted storm water detention filter system and sidewalk with certain portions of the sidewalk torn away and with earth removed from one end of the detention filter system for viewing clarity, thus illustrating a preferred embodiment of my invention.

Referring now to the drawing figures and, in particular to FIGS. 1–4 there is shown, in a preferred embodiment of my invention, a storm water detention filter system, generally designated 10. The system 10 includes at least one conventional gabion box, two of such boxes 12*a* and 12*b* being shown in FIG. 1, which boxes are disposed end-to-end closely against a vertical earth cut or earth wall 16. Typically, the gabion boxes 12*a* and 12*b* are commercially available in standard dimensions such as 3 ft.×3 ft.×12 ft. and include a metal box shaped frame with the open portions of the frame being covered by cross-linked wire mesh. Other gabion boxes can be obtained which are 3 ft.×1 ft.×12 ft., 3 ft.×2 ft.×12 ft. and other sizes as desired. An upper surface of the boxes 12*a* and 12*b* forms a hingable lid that can be tilted open such that the boxes can be filled with limestone or other rock chunks, commonly known as rip rap, typically of a size or gauge in the range of from about three inches to about 5 inches in diameter or length dimension. The mesh size of the wire used to enclose the boxes must be of a gauge suitable for containing the rock size selected for filling the boxes. In the present example, an upper rear edge portion of the boxes 12*a* and 12*b* rises above the earth wall 16 and abutts against an edge of a pavement rock base 18 over which is applied an asphalt or concrete surface 20, thus forming a parking lot and roadway having a gradual slope downwardly toward the boxes as shown best in FIG. 2. A liquid impervious plastic sheet 22 is placed between the earth wall 16 and opposing vertical rear sides of the gabion boxes 12*a* and 12*b* along the entire length of the cut 16 to stabilize the earth wall from eroding into the gabion boxes and to prevent backflow of water from the boxes into the pavement subgrade. An upper edge portion 23 of the sheet 22 extends between an edge portion of the pavement rock base or subgrade 18 and an underlying surface portion 25 of the earth to anchor the sheet in place. Spikes may be used to hold the sheet 22 in earth 16 until the pavement construction is complete. Similarly, a lower edge portion 24 of the sheet 22 lies on the ground under the gabion boxes 12*a* and 12*b* and extends completely across the bottom thereof for stabilizing the earth below the boxes against erosion. Another layer of the sheet 22 is placed across the top of the boxes, except under the ledge 31 to prevent penetration of wet concrete from a sidewalk 33 into the boxes during construction. The plastic sheet 22 with lower edge portion 24 thus permits storm water runoff, indicated by arrows 28 above the asphalt or concrete surface 20, to drain into an upper surface portion 30 (See FIG. 2) of the gabion boxes 12*a* and 12*b* under the ledge 31 of the overlying concrete sidewalk 33 so as to temporarily accumulate in the base of the boxes due, in part, to a slight liquid holding action of the rip rap therein.

Figure 2:
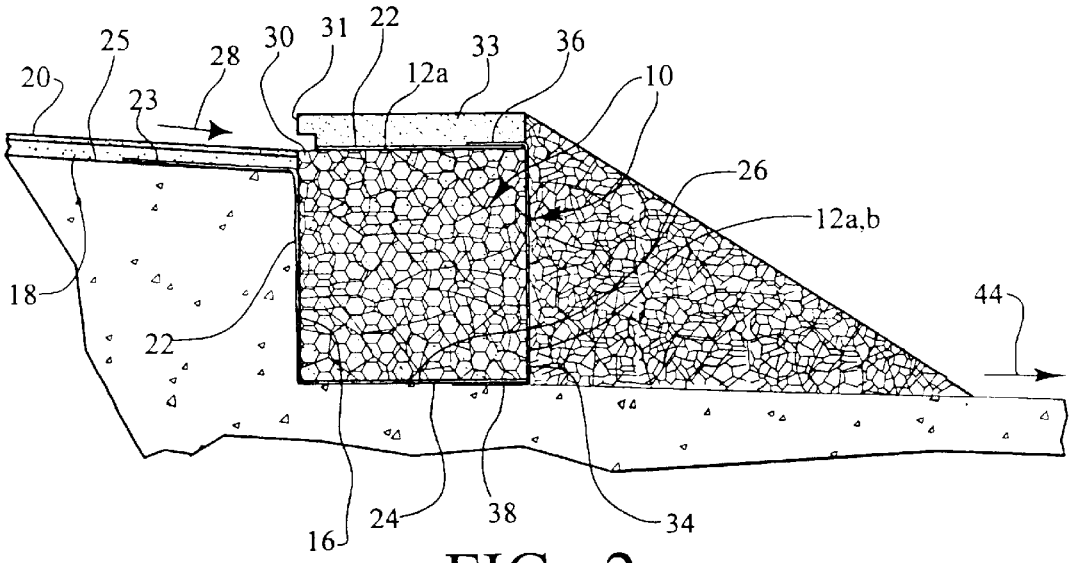
FIG. 2 shows an end elevation view of the detention system and sidewalk of FIG. 1 with rip rap added to a downstream front side thereof.
Figure 3:
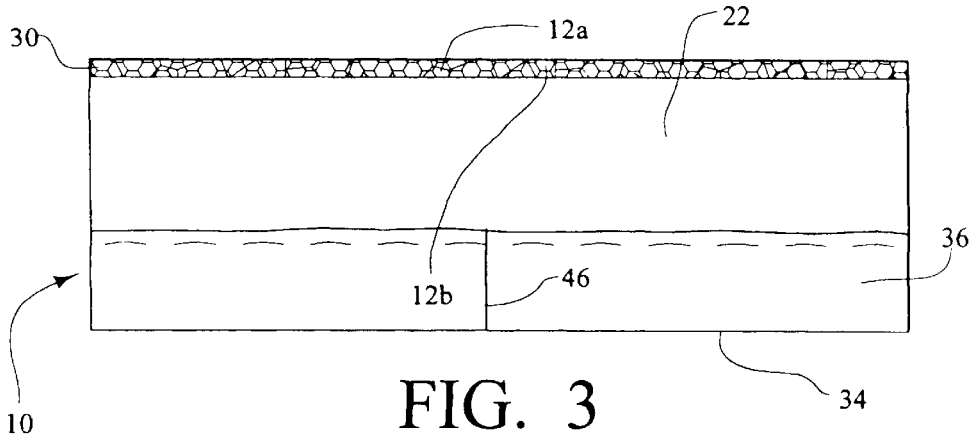
FIG. 3 shows a top plan view of a portion of the detention filter system of FIGS. 1–2 with sidewalk and other features removed.
Figure 4:
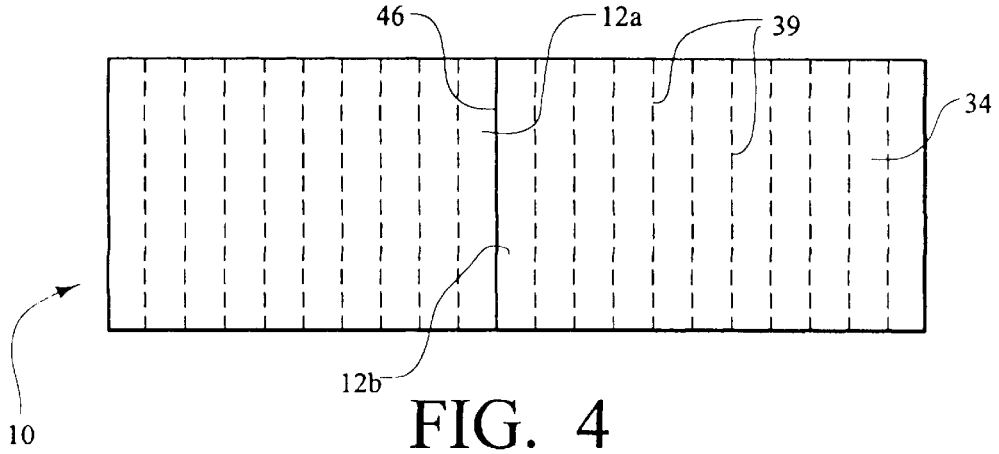
FIG. 4 shows a front surface elevation view of the detention filter system of FIGS. 1–3.

The system 10 also includes one or more sheets 32*a* and 32*b* of porous, liquid permeable, flexible fabric as needed, two of which sheets are shown in FIG. 1, which sheets are attached to and cover downstream, front vertical surfaces 34 (See FIG. 2) of the boxes 12*a* and 12*b*. The sheets 32*a* and 32*b* may also be perforated, flexible plastic sheets, to which the term "liquid permeable sheets", as later used herein, also refers. Upper and lower edge portions 36 and 38 of the sheets 32*a* and 32*b* are folded over edge portions of the upper and lower surfaces, respectively, of the boxes 12*a* and 12*b* and are affixed to the wire mesh thereof in any suitable manner, such as by means of manually twisted short strands 39 of wire. See FIG. 1. Likewise, the front vertical surfaces of the sheets 32*a* and 32*b* also can be affixed to the wire mesh on the front of the boxes by short strands 39 of manually twisted wire as also shown in FIG. 1. The porous fabric or perforated sheet, as at 32*a* and 32*b*, is selected so as to limit the rate of flow of runoff water therethrough to a maximum number of gallons per minute per square foot, which will preferably be less than and certainly no greater than the natural rate of runoff of storm water from the tract which occurred prior to construction of improvements thereon. The improvements previously referred to are the combination stone and asphalt or concrete pavement parking on the lot and roadway 18, 20 of the present example as shown in FIGS. 1–2. The actual number of gabion boxes employed, will depend upon the length of the edge of the parking lot/roadway 18, 20 and that of the earth cut 16 along which storm water runoff is to be regulated. For an edge length of 200 feet, for example, a total of 17 gabion boxes placed end-to-end will be required. Thus, the system 10 permits control of storm water runoff along a long, relatively thin (3 feet) area closely following the edge of a developed area on the tract, rather than taking up a broad surface area as in the case of a conventional storm water detention pond. Moreover, the resulting long, thin detention filter need not form a straight line but can follow a curved course if necessary. Even in the case of the three foot width of this storm control system, a portion of that width is used for the sidewalk 33.

In the present example, the concrete sidewalk 33 is formed on top of the boxes 12*a* and 12*b* and the overlying sheet, and contains an undercut or overhanging ledge 31 along the upstream side of the sidewalk to expose the upper surface edge portion 30 of the boxes to receive storm water runoff 28 from the asphalt surface 20. Thus, in the present example, even the width of the system 10 itself can contain surface improvements so that there is virtually no loss caused by the system 10 in the area that can be developed. To stabilize the gabion boxes 12*a* and 12*b* against the earth cut 16 and to eliminate what would otherwise be a vertical drop off from the downstream side of the sidewalk 33, rip rap or rock particles 42 may be piled against the downstream surfaces 34 of the boxes, as shown only in FIG. 2, so as to slope downwardly away from the system 10. Assuming the appropriate porous filter fabric or porous sheet is selected for use with the boxes 12*a* and 12*b*, the boxes will temporarily accumulate some of the storm water runoff 28 therein and will reduce the velocity thereof and, hence, the rate of runoff 44 discharged from the system 10.

Preferably, the porous, liquid permeable sheets 32*a* and 32*b* are formed of porous, woven fabric or perforated sheets of material, such as plastic, and should have a maximum drain rate therethrough which is as close to the desired maximum rate of runoff 44 from the developed tract to a stream, flood ditch, storm sewer or the like, the rate of runoff 44 being preferably no greater than the natural rate of runoff of the tract prior to development. To accomplish such a result may require applying two or more sheets 34 of liquid permeable fabric or perforated sheets to each of the boxes 12*a* and 12*b*, one over the other, in two layers. It may also be advisable to place a liquid impervious sheet or sheets, as the case may be, between adjacent ends of each of the boxes 12*a* and 12*b*, as at 46 in FIGS. 1 and 3–4, to allow each of the boxes to form a separate cell for the collection of runoff 28 from separate strip areas of the developed lot 20 above. A satisfactory material which I have used in forming the liquid permeable sheets 32*a* and 32*b* of a system, such as shown at 10, is that commercially available which is known as AMOCO No. 2006 which has a maximum flow through rate of about 4.0 gal. per minute per square foot. This material is available from Amoco Corporation, 900 Circle 75 Parkway, Atlanta Ga. 40339 and from NILEX Corporation, 15171 East Fremont Drive, Englewood, Calif. 80112. My experimentation indicates that by using two layers of AMOCO No. 2006 for the sheets 32*a* and 32*b*, the maximum flow rate of the runoff 44 can be reduced to about 2.55 gallons per minute per square foot.

Figure 5:
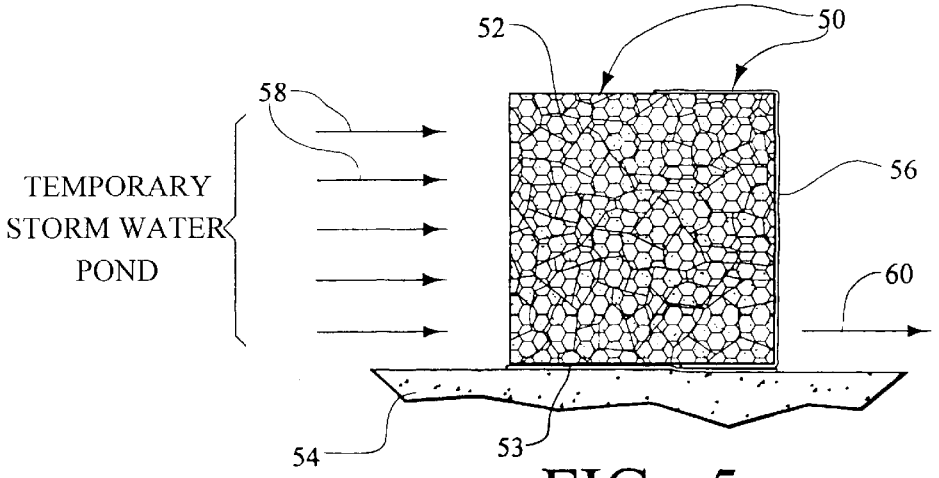
FIG. 5 shows an end elevation view of a storm water detention filter system, thus illustrating another important embodiment of my invention.

Referring now to FIG. 5, there is shown, in another important embodiment of my invention, a storm water detention filter, generally designated 50, comprising one or more rip rap filled gabion boxes 52 disposed over a liquid impervious plastic sheet 53 on an earth surface 54 in, end-to-end relationship, if applicable, and a liquid permeable or perforated sheet 56 covering a front surface of the boxes 52 and overlapping upper and lower front surfaces thereof. In this example, the filter 50 forms a porous dam or barrier for storm water 58 which can accumulate behind and build up vertically along a rear side thereof to form a storm water pond. Such storm water 58 will enter the rear side of the gabion box or boxes 52, accumulate and build up vertically therein and pass through the pores or perforations of the sheet 56 as at 60 at a reduced rate of flow. Again, as in the previous example, the sheet 56 may be formed of two layers of porous fabric or perforated sheet to reduce the flow rate therethrough from that which would exist with only a single layer in the sheet 56.

Figure 6:
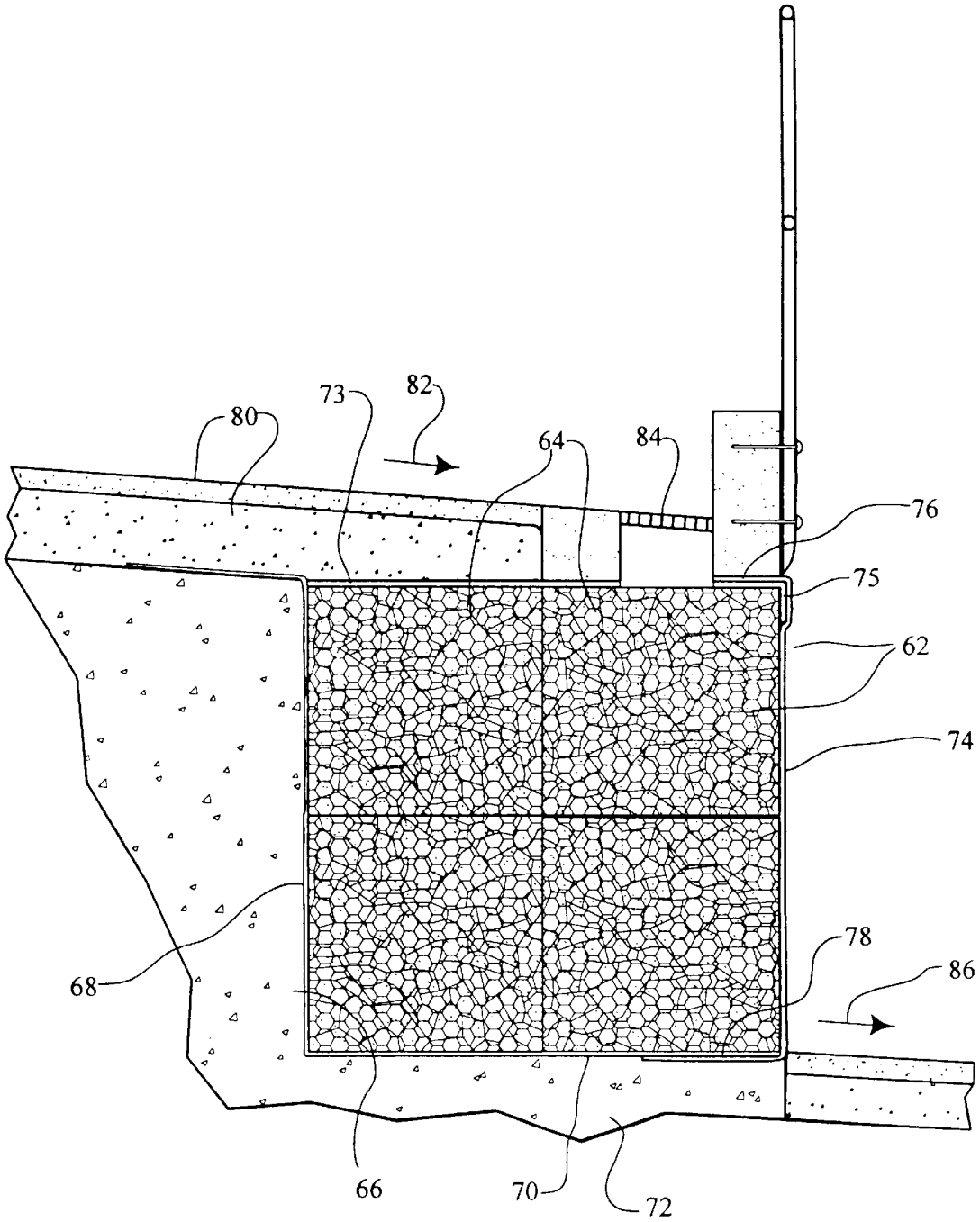
FIG. 6 shows an end elevation view of a storm water detention filter, thus illustrating yet another important embodiment of my invention.

Referring now to FIG. 6, in yet another important embodiment of my invention, there is shown a storm water detention system generally designated 62. In this example, the system 62 contains two columns of rip rap filled gabion boxes 64, two rows deep against an earth wall or cut 66. As each of the boxes 64 are about 3 feet high, the earth cut immediately behind the boxes is about 6 feet in height. A liquid impervious plastic sheet 68 is placed between the earth wall 66 and the rear surfaces of the boxes 64 to prevent water erosion of the wall 66 into the boxes, the same as in the first example relating to FIGS. 1–2. An upper end portion 69 of the sheet 68 lies upon an upper surface of the ground 72 under the rock subgrade of an asphalt or concrete roadway 80. A lower edge portion 70 of the sheet 68 covers the ground 72 underneath the boxes 64. Other liquid impervious sheets 73 and 75 cover the top of the boxes 64, except that part underlying a grate 84, to prevent liquid concrete from penetrating the boxes during construction. A porous, liquid permeable fabric or perforated sheet 74 is attached to the wire mesh of the front surface of the boxes 64, as by means of twisted wire strands, and completely covers the front vertical surface thereof. The sheet 74 has an upper portion 76 and a lower portion 78 which overlaps upper and lower front edge portions, respectively, of the gabion box assembly 64. The rock based or asphalt concrete roadway and/or parking lot 80 is formed on the earth surface to the left of the cut 66 as viewed and extends partially across the box assembly 64. The roadway/parking lot 80 should slope toward the right as viewed to carry storm water runoff, as indicated by an arrow 82, to the grate 84 above the system 62 where it is discharged into the boxes 64. The boxes 64 allow for a much greater accumulation of storm water runoff therein than is possible using the single gabion box or single row of gabion boxes as in the previous two examples. Here, again, the porous or perforated sheet 74 may contain two or more layers of liquid permeable fabric as needed to limit the maximum runoff rate on the downstream side of the system 62, as indicated by an arrow 86.

Figure 7:
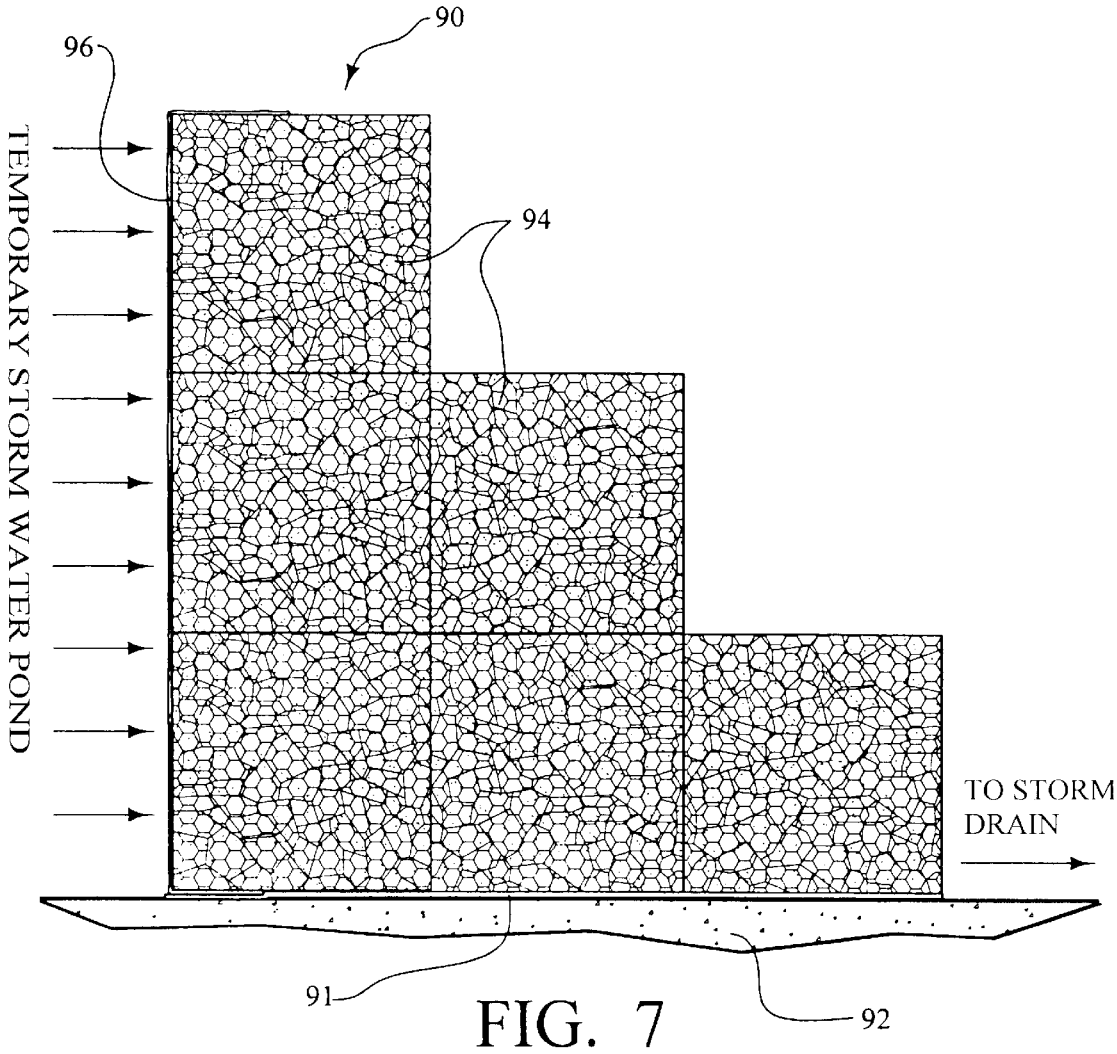
FIG. 7 shows an end elevation view of a storm water detention filter, thus illustrating still another important embodiment of my invention.

Referring now to FIG. 7, another example of a storm water detention filter system, generally designated 90 is shown. Here, as in the example of FIG. 5, the system 90 is mounted over a liquid impervious plastic sheet 91 spread on the ground 92 so as to form a porous dam or barrier to storm water runoff accumulating and building up in a temporary pond behind a series of rip rap filled gabion boxes 94. In the present example, a first column of the boxes is three boxes high or approximately 9 feet in height using commercially available standard boxes. A second or middle column of boxes 94 is two boxes high and a third column is only a single box high. In this example, the system 90 also contains a sheet of porous, water permeable fabric in the form of a sheet 96 which, in this case, is located on a rear or upstream side of the gabion boxes 94 facing the pond and has upper and lower edge portions which overlap upper and lower surface portions of the first column of the boxes. Here, again, the sheet 92 is fastened to the wire mesh on the rear sides of the gabion boxes using short strands of wire which may be readily twisted. By contrast, notice in the FIG. 5 example that the porous sheet 56 is located on a front or downstream side of the box or row of boxes 52. Here, as in the previous examples, the sheet 96 may comprise more than one layer of a porous fabric such as AMOCO No. 2006. In the alternative, liquid impervious sheet, such as plastic may be used, which has been perforated to obtain the desired flow through rate.

Although the present invention has been described with respect to specific details of a certain preferred and other important embodiment(s) thereof, it is not intended that such details limit the scope of this invention other than as specifically set forth in the following claims.

I claim:

1. A storm water detention filter system comprising at least one gabion box filled with rock particles for receiving storm water runoff from a tract of land therein, said gabion box being positioned with a rear wall thereof against an earth wall;

a liquid impervious sheet of material disposed between said earth wall and said rear wall of said box to inhibit dirt from eroding from said earth wall into said box, a lower edge portion of said liquid impervious sheet extending across the ground under said box; and a sheet of porous, liquid permeable material attached to and covering a front wall of said at least one gabion box opposite said rear wall for reducing the flow rate of storm water passing through said box and porous sheet from said tract to a storm drain.

2. The system of claim 1 wherein said rock particles comprise chunks of rock of a preselected size in the range of from about 3 inches to about 5 inches in diameter.

3. The filter system of claim 1 wherein said at least one gabion box comprises a plurality of gabion boxes disposed end-to-end.

4. The filter system of claim 3 further comprising a second plurality of gabion boxes disposed end-to-end and stacked upon the first mentioned plurality of gabion boxes, a third plurality of gabion boxes disposed end-to-end and mounted next to the first mentioned plurality of boxes, and a fourth plurality of gabion boxes disposed end-to-end and stacked upon said third plurality of boxes, said porous sheet being attached to and covering a vertical surface of said third and fourth pluralities of boxes.

5. In combination with a storm water pond, a storm water detention filter system comprising at least one ground mounted gabion box filled with rip rap, said box being disposed so as to receive through an open surface thereof and accumulate therein a quantity of storm water runoff from said storm water pond and;

at least one sheet of porous material attached to and covering a vertical surface of said gabion box to form a temporary barrier or dam for said storm water pond to limit the rate of storm water runoff from said storm water pond to a storm drain.

6. The system of claim 5 wherein said at least one sheet comprises a porous fabric.

7. The system of claim 5 wherein said at least one sheet comprises a perforated sheet of otherwise liquid impervious material.

8. The system of claim 7 wherein said material comprises flexible plastic sheeting.

9. In combination with a storm water pond, a storm water detention filter system comprising a plurality of gabion boxes filled with rock particles and positioned end-to-end so as to form a temporary barrier or dam for said pond; and at least one sheet of porous, liquid permeable material attached to and covering a vertical surface of said plurality of gabion boxes so as to reduce the flow rate of storm water passing through said boxes and said at least one sheet from said pond to a storm drain.

10. The combination of claim 9 wherein said at least one sheet of porous, liquid permeable material is attached to and covers a rear, pond facing surface of said boxes.

11. The combination of claim 9 wherein said at least one sheet of porous, liquid permeable material is attached to and covers a front, downstream facing surface of said boxes opposite said pond facing surface.

* * * * *